United States Patent [19]

Edwards et al.

[11] 4,028,823

[45] June 14, 1977

[54] DIGGING TOOTH

[76] Inventors: Gerald D. Edwards, Rte. 1, Box 15a, Dubberly, La. 71024; Floyd B. Edwards, Rte. 3, Box 436, Canton, N.C. 28716

[22] Filed: Oct. 31, 1975

[21] Appl. No.: 627,686

[52] U.S. Cl. ..... 37/142 R; 172/719; 172/766

[51] Int. Cl.[2] ..... E02F 9/28

[58] Field of Search ..... 37/142 R, 142 A, 141 R, 37/141 T; 172/713, 724, 726, 730, 761, 766, 769, 770, 719

[56] References Cited

UNITED STATES PATENTS

| | | | |
|---|---|---|---|
| 289,797 | 12/1883 | Ball | 172/719 |
| 383,402 | 5/1888 | Martin | 172/724 |
| 1,237,610 | 8/1917 | Brenno | 172/766 X |
| 1,346,261 | 7/1920 | Schmutte | 172/766 X |
| 2,013,818 | 9/1935 | Wiese | 172/719 |
| 2,642,305 | 6/1953 | Butler | 172/766 |
| 3,202,222 | 8/1965 | Norris | 172/719 X |
| 3,203,488 | 8/1965 | Eastwood | 172/713 |
| 3,736,676 | 6/1973 | Sturgeon | 172/713 |
| 3,923,104 | 12/1975 | Tibbs | 172/730 |

FOREIGN PATENTS OR APPLICATIONS

| | | | |
|---|---|---|---|
| 125,442 | 12/1967 | Czechoslovakia | 37/142 |
| 80,317 | 6/1952 | Norway | 172/713 |
| 281,268 | 7/1970 | U.S.S.R. | 37/142 R |

OTHER PUBLICATIONS

"Steel Castings to Meet Industry's Requirements", Foundry Management & Technology; p. 29, Sept. 1975.

*Primary Examiner*—E. H. Eickholt
*Attorney, Agent, or Firm*—Frederick W. Turnbull

[57] ABSTRACT

A digging tooth provided with two points for use especially at the corners of a power digging bucket so that the shovel cuts better at its corners resulting in less binding of the bucket when making a second cut. This also results in better corners at the bottom of a narrow ditch.

3 Claims, 3 Drawing Figures

DIGGING TOOTH

The leading edge of digging buckets for power shovels, back hoes, and similar devices are filled with spaced teeth. It has been found that pointed teeth such as disclosed in U.S. Pat. No. 3,055,128 are especially desireable.

The two sides of a digging bucket, however, using a pointed tooth will not provide a sharp corner on the ditch being dug, and the edge of the bucket itself will become eroded as it will be found that the bucket teeth, not cutting to the full width of the bucket, the bucket edge is scraped by the saids of the ditch being dug. The tooth of the present invention is also of especial use for "scrubbing" for the removal of bushes and other plants from an area being cleared by a front loader.

It is an object of the present invention, therefore, to provide a tooth to be used especially at the two edges of a digging bucket that will cut accurately to the edge or corner of the cut in the earth made at each pass of the bucket, and which will be especially effective in "scrubbing" land with a front loader.

Other and further objects and advantages will appear from the following specification taken with the accompanying drawing in which like reference characters refer to similar parts in the several views and in which.

The front edge or lip of a digging bucket is provided with a plurality of spaced sockets 10, 10*a*, and so forth. The number of sockets being a function of the width of the bucket. An adapter 12 may be mounted in each socket, and a tooth 14 is mounted on the front of the adapter. While the tooth 14 is especially useful at the extreme edges of the bucket they may be used in other locations as along the lip of a front loader to be used for scrubbing.

Figure 1:
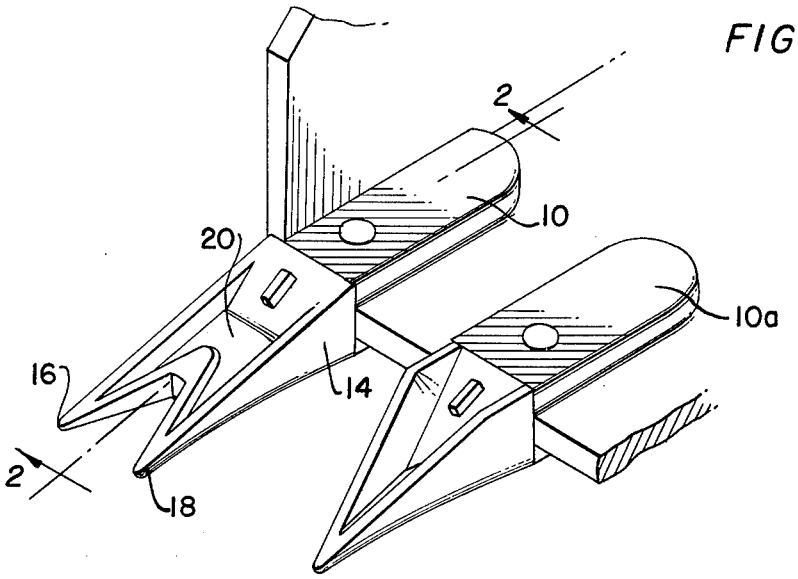
FIG. 1 is a fragmentary front perspective view of a corner of a digging bucket showing the tooth of the present invention and one other tooth.
Figure 2:
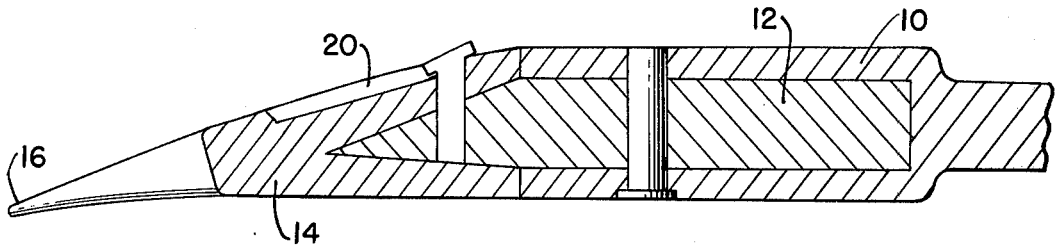
FIG. 2 is a section taken on line 2—2 of FIG. 1.
Figure 3:
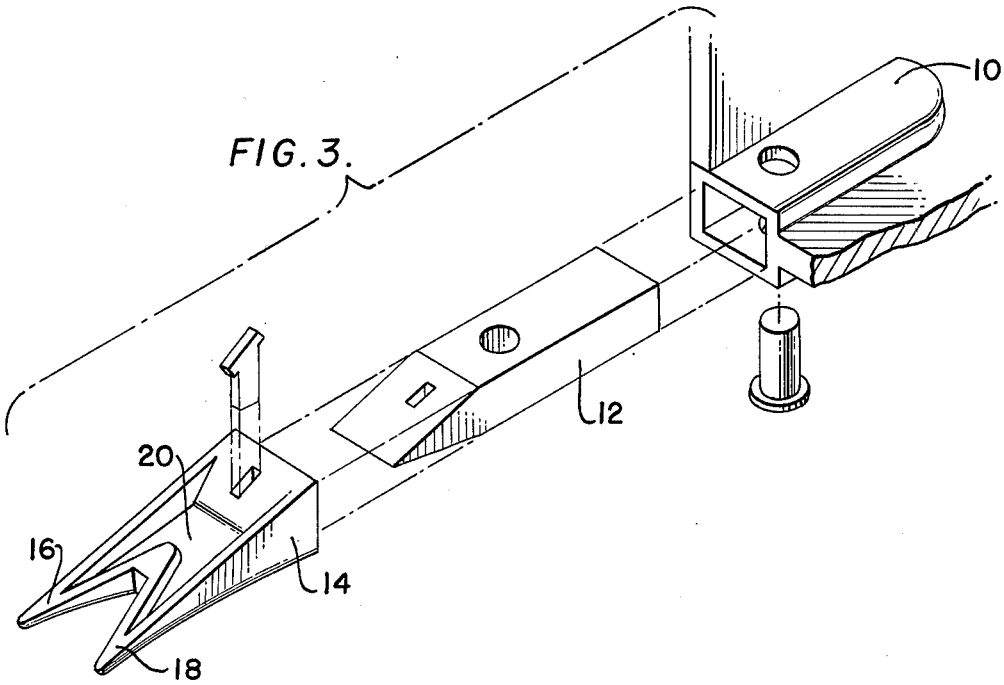
FIG. 3 is an exploded view showing how the tooth may be mounted on the bucket.

The tooth 14 is provided with two points 16 and 18 and there is a deep cleft between them. Points 16 and 18 are mirror images of each other about the plane of the center of the tooth. The side surfaces of the tooth preferably, but not necessarily, flare slightly outwardly so that the point 16, as seen in FIGS. 1 and 3, or point 18 when the tooth is used on the other corner of a digging bucket, will project at least to the plane of the outside edge of the bucket. The top surface of the tooth slopes downwardly from the rearward to the forward portion of the tooth, and the bottom surface lies generally parallel to the outer bottom surface of the bucket. The bottom surface may be slightly curved downwardly. The top surface of the tooth is provided with a depression 20 so that the top edges of the tooth present a generally W shape when viewed from above.

While the point 16 of tooth 14 cuts to an accurace corner, it will be noted that if only point 16 were provided, excessive forces would bear on point 16 which would tend to turn it outwardly. By having the second point 18, the thrust against the tooth is axial of the tooth so will not exert an outward or sideways thrust on the tooth. The stresses on the double pointed teeth at the corners of the bucket will, therefore, be the same as the stresses transmitted to the other teeth along the bucket lip.

The double pointed tooth of the present invention may be used in lieu of other shaped teeth along the lip of a digging bucket and along the lip of front end loaders especially when used for scrubbing as it gives exceptionally good penetration and scooping action. It may be used also on any earth moving equipment such as scarifiers and wheel ditchers where penetration of the earth is required.

Having thus disclosed my invention I claim:

1. A tooth for a power digger having a socket to receive a shank mounted on a digging bucket or the like comprising a rearward portion in which the socket is formed and a forward portion, a top, a bottom and two side surfaces, said top surface sloping downwardly to meet said bottom surface at the forward end of said forward portion, said forward portion comprising two elongated forwardly extending points separated by a cleft, the outer sides of said tooth points being substantially parallel. Said top surface being also formed with a depression extending across said rearward portion and having a portion of said depression extending forwardly in the top surfaces of said elongated points whereby the tooth presents a generally W form when viewed from a position toward which it is moved when in use.

2. The tooth for a digging bucket as in claim 1 in which said side surfaces flare slightly from said rearward portion to the ends of said elongated points.

3. The tooth for a digging bucket as in claim 1 in which said bottom surface curves downwardly from said rearward portion to said points.

* * * * *